United States Patent [19]

Deni

[11] Patent Number: 5,025,691

[45] Date of Patent: Jun. 25, 1991

[54] PUNCH GUIDE

[76] Inventor: Frank Deni, 20 Norris St., Buffalo, N.Y. 14207

[21] Appl. No.: 367,009

[22] Filed: Jun. 16, 1989

[51] Int. Cl.[5] ..... B26F 1/14

[52] U.S. Cl. ..... 83/140; 83/143; 83/685; 83/698; 83/821

[58] Field of Search ..... 83/123, 124, 125, 126, 83/136, 137, 138, 140, 143, 383, 387, 821, 698, 685, 684, 687, 691

[56] References Cited

U.S. PATENT DOCUMENTS

| | | | |
|---|---|---|---|
| 2,107,581 | 2/1938 | Parsons et al. | 83/698 X |
| 2,362,032 | 11/1944 | Smith | 83/698 X |
| 2,757,735 | 8/1956 | Taylor | 83/137 |
| 3,125,917 | 3/1964 | Smeets | 83/140 |
| 3,496,818 | 2/1970 | Porter et al. | 83/140 |
| 3,540,339 | 11/1970 | Killaly | 83/140 |
| 3,722,337 | 3/1973 | Brolund et al. | 83/137 |
| 4,007,653 | 2/1977 | Cady | 83/698 X |
| 4,257,292 | 3/1981 | Faull | 83/698 X |

*Primary Examiner*—Frank T. Yost
*Assistant Examiner*—Rinaldi Rada
*Attorney, Agent, or Firm*—James J. Ralabate

[57] ABSTRACT

The invention involves a novel structure used in piercing a metal workpiece. Other workpieces made from materials other than metal may be used, if desired. The structure uses a punch plate having movably connected below it a stripper plate. A spring means connects these two plates so that they are movable toward each other. The stripper plate has an aperture centrally located therein and a tubular punch guide fitted over the aperture. A punch housing containing a punch is telescopically fitted within said tubular punch guide and will travel through the length of the punch guide and will travel through the length of the punch guide, through the aperture and puncture a workpiece held below. The tubular punch guide prevents side to side movement of the punch and punch housing to substantialy minimize damage to the punch and supporting structures.

9 Claims, 2 Drawing Sheets

PUNCH GUIDE

This invention relates to a punch and die unit and, more particularly, to a novel punch housing guide.

BACKGROUND OF THE INVENTION

It is known in medium to heavy duty punching units to use various type punch and die supporters. In C-frame holders, for example, there are several units for punching holes in material or workpieces from about ¾ inch to 1 inch thick. Since the workpieces used are comparatively thick, after continuous usage, the C-frame tooling begins to become deflected or offset structurally. When this occurs the holes punched using that particular C-frame equipment become off-centered and non-uniform. Conversely, if the C-frame tooling is somewhat deflected or deformed because of heavy use, the stripper plate and punch used therewith may also deviate from the vertical and horizontal and thus may act upon the workpiece non-uniformly. In addition, after constant usage, the punch because of less than continuous support can become offset and become deflected. This will result in off center holes being imparted into the workpiece. Also, because of a lack of total vertical support, the punch after continuous usage may become irregularly worn and must be frequently replaced. When the punch is worn in an irregular fashion, the holes and resulting slugs therefrom are not as precise or sharp as they should be or as precise as they were when the punch was new and not worn. There is a need for a device that provides substantially continuous vertical support for the punch and punch housing. A structure that reduces shock, deflection of the punch, deflection of the C-frame tooling areas, reduces wear on the punch and reduces the operational noise level would be a major contribution to the art.

There have been several attempts to strengthen the arms of a C-frame holder or tooling. One method that has been attempted to strengthen the upper arm of the C-frame holder is to install support bars on either side of the arm and thereby minimize the deflection of this arm due to structural pressure caused by constant heavy usage. This method has not been successful and upper arm deflection continues to be a problem. As noted earlier, the upper arm supports the punching assembly containing the punch and, if the upper arm is off kilter, all elements supported thereon will be equally off kilter including the punch. This results in holes of various tolerances being imparted in subsequent worked workpieces. Various type workpieces may be used such as metal, plastics, paper goods, fiberglass, and any other suitable materials.

Another corrective measure attempted by the prior art has been to suspend and project metal screws or pins down from the upper arm and up from the lower arm of the C-frame. These pins minimize the gap between the C-frame arms and provide means for supporting a workpiece during the punching operation. While these screw supports or guides have somewhat reduced upper arm deflection of the C-frames, they also became deformed during usage and have not provided a satisfactory solution to this problem.

C-frame structures of the type disclosed in U.S. Pat. Nos. 2,758,560 and 3,461,762 and those illustrated in a catalog published by Unittool Punch & Die Co., Inc. of P.O. Box 863, Buffalo, N.Y. Catalog H-85 are illustrative of the structures that can experience these problems. Obviously, any suitable type holder for punch and die units may be used with the device of the present invention. Therefore, while the present invention will be illustrated as installed in C-frame holders, it is to be understood that the novel unit of this invention has utility in any other suitable type holder.

In the prior art units the punch plate has attached thereto in approximately the center of said plate a punch housing. Inside the punch housing is secured the punch which will impart the desired hole configuration in a workpiece. On either side of the punch housing are stripper springs that provide downward movement to the punch and punch housing when a pressure is exerted upon the punch plate. The springs and punch housing are suspended from and attached to the punch plate. Below the springs and attached thereto is a stripper plate having a central aperture therein through which the punch and punch housing project when making contact with a workpiece during the piercing or punching operation. This aperture is substantially larger than the dimensions of the punch and punch housing and will allow the punch side to side movement during the piercing operation. It is this lateral movement from the vertical axis of the punch that causes in the prior art irregular wear on the punch and eventually deflection and deformation of the upper arm of the C-frame holder which supports the punch housing. Part of this prior art problem is caused because of the large gap between the arms of the C-frame holder and the lack of vertical support for the punch when it impacts upon the workpiece. Also, in the prior art, because of side loading, galling of the workpiece occurs and the punch becomes dull and non-uniform. Without adequate support the punch will chatter and wobble during usage, will make a rapid clicking noise and will vibrate somewhat so as to produce flaws or defects or non-uniformity in the workpiece.

SUMMARY OF THE INVENTION

It is therefore an object of this invention to provide a punch and die unit devoid of the above-noted disadvantages.

Another object of this invention is to provide a novel punch unit structure that will minimize deflection, misalignment or deformation of the C-frame tooling in which it is contained and used.

A further object of this invention is to provide a novel punch unit that reduces wear on the punch and permits less frequent replacement thereof.

Another further object of this invention is to provide a novel punch unit that substantially reduces deflection of the punch during use and upon contact with a workpiece.

Still a further object of this invention is to provide a novel punch unit that is adapted to pierce holes into thicker workpieces with substantially less detrimental effect upon the punch.

Another still further object of this invention is to provide a novel punch unit that causes less galling, wobble, chatter and noise when in operation.

Yet a further object of this invention is to provide a novel punch unit that will substantially prolong the life and stability of the punch and supporting structures and permit higher quality and more uniform work products.

Still yet a further object of this invention is to provide a novel punch unit that will minimize drag up action by the workpiece after the piercing operation.

Yet still another object of this invention is to provide a novel punch unit that will permit substantially continuous vertical and horizontal support for the punch being housed therein.

Another still further object is to provide a method and device for making blanks (cut out pieces) that are burr-free and have smooth edges.

These and other objects are accomplished by the present invention by providing a novel punch unit comprising a stripper plate having a central aperture which is enclosed from above by a cylindrical punch driver stabilizer. This forms a continuous conduit and support for the punch housing and punch up until the time it passes through the stripper plate aperture. The cylindrical punch driver stabilizer extends through substantially the entire vertical dimensions of the punch housing and supports the punch to the maximum extent up until it pierces a workpiece. This support substantially minimizes lateral movement or chatter of the punch, less dragging, with less galling, and reduces punch wear and degradation and minimizes upper arm deformation of the C-frame. As a punch hits a very hard metal workpiece under tremendous pressure, it is normal in prior art devices to expect some eventual structural damage and deformation, the continuous supporting structure of this invention minimizes this effect in both the C-frame and other frames on the punch. The cylindrical punch driver stabilizer of this invention is secured around and encloses the outer periphery of the aperture in the stripper plate and is integral therewith. While the opening of the cylindrical punch driver support or tubular stabilizer is generally coextensive with the aperture in the stripper plate, attachments may be inserted over the open lower end of the stabilizer to accommodate various punches. For example, if a square punch is used, an attachment with a square opening may be used to permit a square punch to snuggly fit therethrough; or if a smaller punch is to be used, an attachment with a small punch opening may be inserted at the terminal open end of the tubular stabilizer. Since the tubular stabilizer (any other suitable shape can be used other than tubular) of this invention is fixed to the stripper plate, it provides maximum support to the punch housing and punch and allows the punch to extend outwardly therefrom at least only to the extent needed to pierce the workpiece. The effects of this vertical support are: substantially reduced deflection of the C-frame arms or other frames, little or no deflection of the workpiece and reduced or no punch deflection. Therefore there is much reduced wear on the punch, reduced or no deflection of the punch during its downward motion and during its contact with the workpiece, sharper and cleaner defined punch holes which are substantially burr-free, the ability to pierce thicker workpieces, a cleaner and more centered cut in workpieces and less wobbling, shock or chattering as the punch hits the workpiece. When blanking, more consistent and definite blanks are produced which also are burr-free when cut with the device of this invention.

DETAILED DESCRIPTION OF THE DRAWING AND PREFERRED EMBODIMENTS

Figure 1:
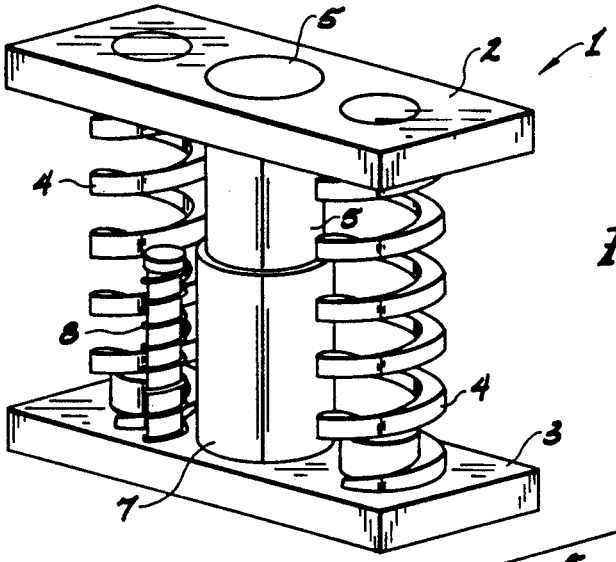
FIG. 1 is a top-side perspective view of the punch guide unit of this invention.
Figure 2:
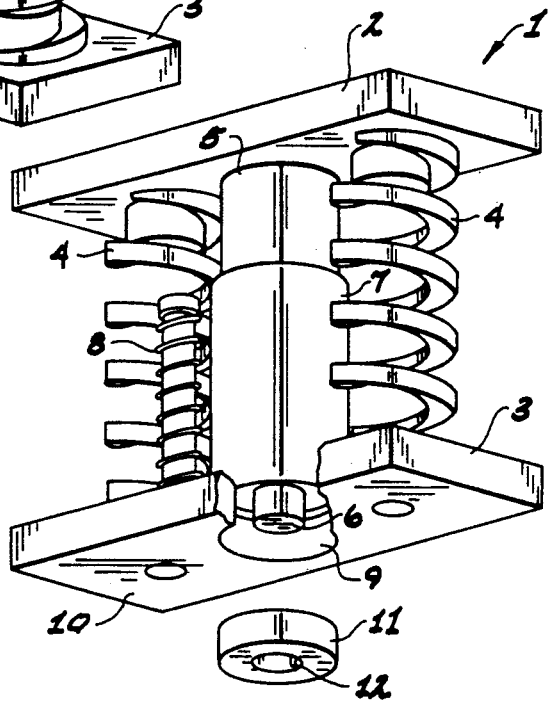
FIG. 2 is a bottom-side perspective view of the punch guide unit of this invention with attachment therefor.
Figure 3:
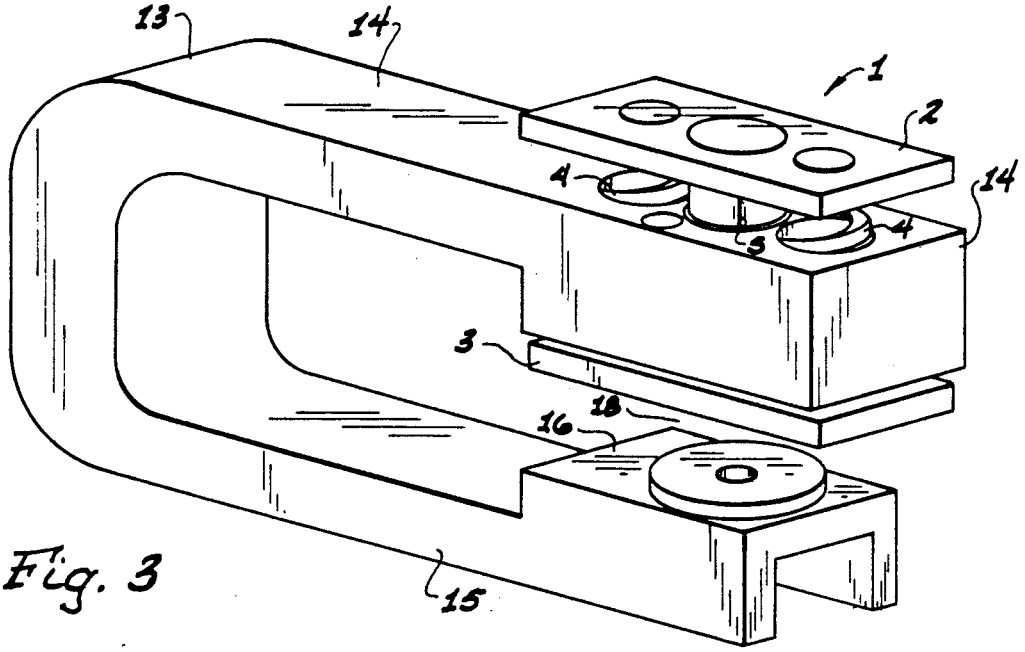
FIG. 3 is a perspective view of a C-frame holder containing and supporting the punch guide unit of this invention.
Figure 4:
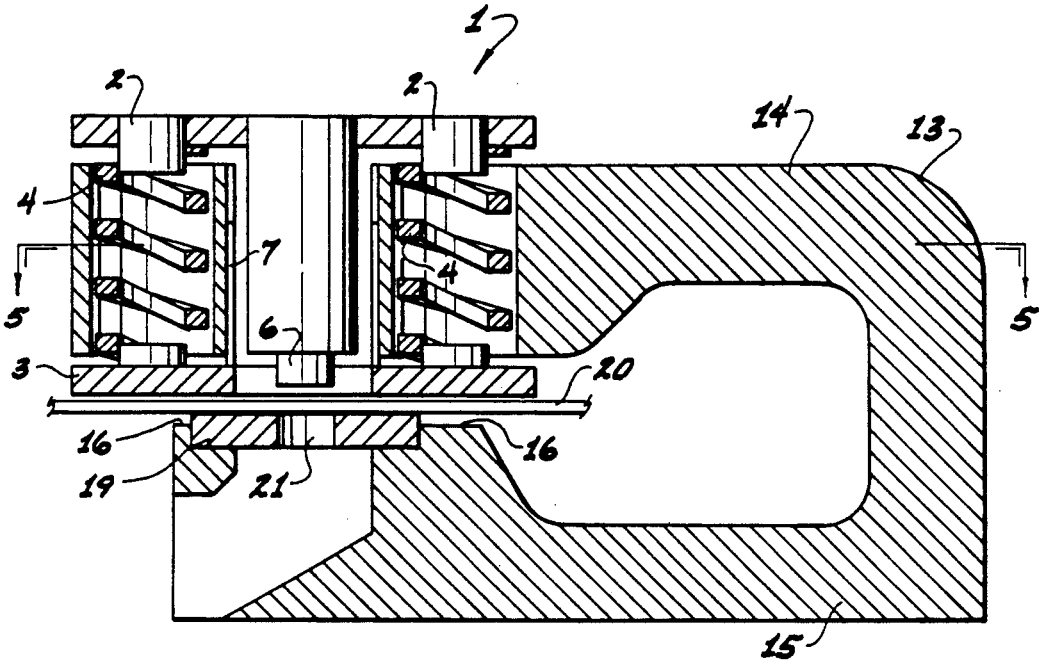
FIG. 4 is a side elevational partially in cross section illustrating the punch guide unit of this invention as used in a C-frame holder.
Figure 5:
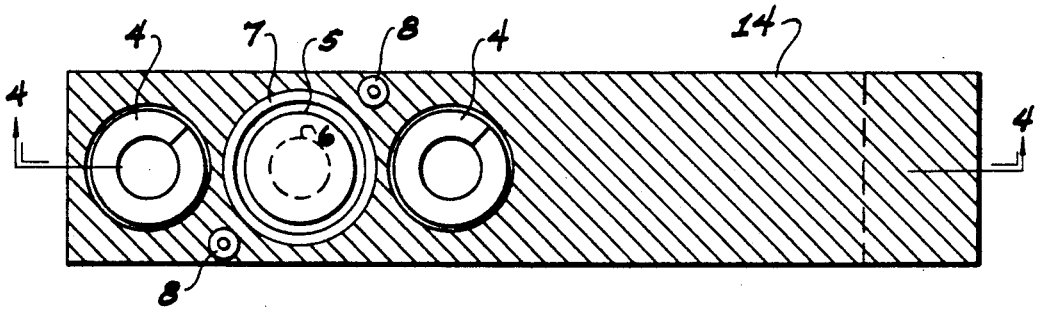
FIG. 5 is a top view in cross section of the C-frame containing the punch guide unit of this invention.

The punch guide unit 1 of this invention is illustrated in FIG. 1 comprising an upper punch plate 2, a stripper plate 3 and movably connecting them together are stripper spring means 4. The spring means 4 are attached and fixed to the lower face of punch plate 2 and the upper face of stripper plate 3 to permit these two plates to be movable toward each other. Fixed to punch plate 2 is a punch housing 5 to which a punch 6 (see FIG. 2 and FIG. 4) is attached and housed. Tubular punch guide 7 is integral with stripper plate 3 and fixed at approximately right angles thereto. Punch guide 7 contains punch housing 5 and prevents it from significant side to side movement during the downward motion of punch housing 5 and punch 6. Punch housing 5 tightly telescopically fits into punch guide 7 and may require some slight lubrication to permit free movement therein. While in prior art devices punch housing 5 is merely suspended from a punch plate-like punch plate 2 without any vertical support means, the present invention provides continuous support for punch housing 5 during its entire downward movement until actual contact is made with a workpiece to be pierced. In the prior art devices, at the time of impact with a workpiece the punch housing 5 and punch 6 without support can be skewed or deflected off center to its vertical axis. Eventually, the punch 6 becomes off-centered and damaged as are the upper arms of a C-frame holder which absorbs a great deal of the impact upon workpiece contact. As pressure is exerted upon punch plate 2 it projects attached punch housing 5 and the contained punch 6 downward through punch guide 7 through an aperture 9 located just below the punch and centrally positioned in stripper plate 3 (see FIG. 2 for aperture location). A lifter spring 8 is provided to propel punch plate 2 back upward to its original position after the workpiece has been pierced. Until the punch 6 contacts the workpiece, punch guide 7 provides continuous support to the punch 6 and punch housing 5 to minimize punch damage and deformation. Unit 1 can be used in any suitable pressure-activating means or support as a C-frame holder or support as shown in FIG. 3. The punch guide unit 1 will be described throughout this specification in reference to a C-frame holder but it should be understood that any type holder may be used. In FIG. 2 a bottom-side perspective view of punch guide unit 1 is illustrated. In stripper plate 3 a central aperture 9 is located through the entire depth of plate 3. Aperture 9 is coextensive with the interior portion of tubular punch guide 7 and provides an unobstructed path to a workpiece that will be used just below and in contact with the lower face 10 of stripper plate 3. As punch plate 2 is pushed downward by any appropriate pressure means, punch housing 5 and punch 6 are forced downward through tubular punch guide 7 and through stripper plate aperture 9 where extending punch 6 contacts and pierces a workpiece. The outer lower exit portion of either aperture 9 or of punch guide 7 can have an attachment 11 that fits over said exit portion but has therein an aperture in the configuration of punch 6 to permit punch 6 to travel therethrough. This attachment 11 can be removable or changeable to accommodate various punch configurations such as squares, triangles and the like. Attachment 11 is shown with a circular cutout 12 to accommodate the circular configuration of punch 6. This attachment 11 provides additional vertical and horizontal support for punch 6 leaving the only unsupported vertical distance for punch 6 as the distance or depth of the workpiece to be pierced. The outer peripheral portion of attachment 11 will fit and be fixable within either the terminal end of punch housing 5 or of stripper plate aperture 9. In FIG. 3 a C-frame holder 13 containing the punch guide unit 1 of this invention is illustrated. The C-frame holder has an upper arm 14 and a lower arm 15. Projecting upward from the terminal end of lower arm 15 is a work platform 16 having a die or button 17 therein. There is a space or gap 18 between work platform 16 and stripper plate 3 through which the workpiece sheet to be pierced is inserted. As pressure is exerted upon punch plate 2 spring loaded punch 6 and punch housing 5 are forced downward until punch 6 exits below stripper plate 3 and pierces the workpiece. Upon constant usage under substantial pressures in prior art devices, upper arm 14 begins to become deformed, off center and could cause off center piercing that is, caused by the contact pressure of the punch 6 and a workpiece being transferred to the upper arm 14 because of lack of vertical support for the punch 6. With the punch guide unit 1 of this invention deformation of upper arm 14 is surprisingly kept to a minimum. In addition, because of this continuous punch support, the structure of the present invention allows very little if any punch deformation. In FIGS. 4 and 5 a side and top view in cross-section of C-frame holder 13 and the punch guide unit 1 of this invention are illustrated. C-frame holder 13 comprises an upper arm 14 and a lower arm 15. Lower arm 15 has at its terminal portion a raised platform 16 which holds the die or button 19. Die 19 has an aperture 21 which mates exactly with the configuration of punch 6 which will pass therethrough after piercing the workpiece 20. While two stripper springs 4 are illustrated throughout the drawings any number of stripper springs 4 greater than one may be used depending upon the workpiece requirements. The substantially total vertical support for punch 6 can be seen in FIG. 4 as punch guide 7 extends through substantially the distance from punch plate 2 to stripper plate 3 and reduces significantly any damaging side to side vibration, chattering or other deviation from the vertical axis of punch 6 during the impact or piercing operation. It is critical to the invention that the punch guide 7 be attached to the stripper plate 3 and provide continuous support for the punch up to the time it impacts a workpiece.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A punch guide unit comprising in combination a punch plate, a stripper plate, a punch housing, a tubular punch guide with a hollow inner portion, and spring means to movably connect said stripper plate and said punch plate, said stripper plate having an aperture extending therethrough, said punch housing attached to an suspended from said punch plate, said punch housing having means to contain and hold in position a punch, said punch housing telescopically fitted into said tubular punch guide and freely movable in a vertical direction within the inner portion of said tubular punch guide, said tubular punch guide coextensive with said aperture and fixed to said stripper plate over said aperture, said tubular punch guide providing a vertical support to said punch housing and said punch to a point when said punch makes contact with a workpiece thereunder.

2. The punch guide unit of claim 1 wherein said spring means comprise at least two springs positioned vertically adjacent both sides of said tubular punch guide.

3. The punch guide unit of claim 1 wherein said spring means are attached to a lower face of said punch plate and an upper face of said stripper plate, and have positioned therebetween said tubular punch guide.

4. The punch guide unit of claim 1 wherein said tubular punch guide is perpendicularly fixed to said stripper plate and substantially parallel to a vertical axis of said spring means.

5. The punch guide unit of claim 1 wherein a bottom portion of said tubular punch guide is completely open to permit passage of said punch therethrough.

6. The punch guide unit of claim 1 wherein a bottom portion of said tubular punch guide is enclosed by an attachment means, said attachment means having an aperture therein conforming to the configuration of said punch, and which will permit said punch to fit therethrough to contact a workpiece.

7. The punch guide unit of claim 1 having at least one lifter spring means positioned on said stripper plate vertically adjacent said tubular punch guide.

8. A punch guide unit comprising in combination a punch plate, a stripper plate, a punch housing, a tubular punch guide, and spring means to movably connect said stripper plate and said punch plate, said stripper plate having an aperture extending therethrough, said punch housing attached to and suspended from said punch plate, said punch housing having means to contain and hold in position a punch, said punch housing telescopically fitted into said tubular punch guide and freely movable therein in a vertical direction, said tubular punch guide coextensive with said aperture and fixed to said stripper plate over said aperture, said tubular punch guide providing a vertical support means to said punch housing and said punch to a point when said punch makes contact with a workpiece thereunder.

9. A punch guide unit comprising in combination a punch plate, a stripper plate, spring means, a punch housing and a tubular punch guide, said punch plate and said stripper plate disposed substantially parallel to each other in a spaced relationship, said spring means movably connecting said punch plate and said stripper plate and connected thereto in a perpendicular fashion, said stripper plate positioned below said punch plate and having an aperture substantially centrally located therethrough, said tubular punch guide having a tubular inner portion and positioned over said aperture and providing a vertical housing and vertical support for said punch housing which telescopically fits therein, said punch housing tightly fitted within said inner portion of said tubular punch guide and having substantially no horizontal movement, said tubular punch guide coextensive with said aperture and fixed to said stripper plate over said aperture, said tubular punch guide providing vertical support to said punch guide and said punch to a point when said punch makes contact with a workpiece placed thereunder.

* * * * *